US006972746B1

(12) United States Patent
Takayama et al.

(10) Patent No.: US 6,972,746 B1
(45) Date of Patent: Dec. 6, 2005

(54) ACTIVE MATRIX TYPE FLAT-PANEL DISPLAY DEVICE

(75) Inventors: Ichiro Takayama, Ibaraki (JP); Michio Arai, Tokyo (JP)

(73) Assignees: Semiconductor Energy Laboratory Co., Ltd., Kanagawa-ken (JP); TDK Corporation, Tokyo (JP)

( * ) Notice: Subject to any disclaimer, the term of this patent is extended or adjusted under 35 U.S.C. 154(b) by 0 days.

(21) Appl. No.: 09/394,345

(22) Filed: Sep. 13, 1999

Related U.S. Application Data

(62) Division of application No. 08/547,919, filed on Oct. 25, 1995, now Pat. No. 5,986,632.

(30) Foreign Application Priority Data

Oct. 31, 1994 (JP) ..... 6-267244

(51) Int. Cl.[7] ..... G09G 3/36
(52) U.S. Cl. ..... 345/92; 345/80; 345/205
(58) Field of Search ..... 345/76, 92, 80, 345/45, 46, 82, 100, 205

(56) References Cited

U.S. PATENT DOCUMENTS 3,885,196 A * 5/1975 Fischer ..... 345/80
4,042,854 A * 8/1977 Luo et al. ..... 313/505
4,266,223 A 5/1981 Frame
4,368,467 A * 1/1983 Unotoro et al. ..... 345/1
4,511,756 A 4/1985 Moeller et al.
4,523,189 A * 6/1985 Takahara et al. ..... 345/80
4,602,192 A 7/1986 Nomura et al.
4,837,566 A * 6/1989 Channing et al. ..... 345/76
5,028,916 A 7/1991 Ichikawa et al.
5,095,248 A * 3/1992 Sato ..... 315/169.3
5,250,931 A * 10/1993 Misawa et al. ..... 345/206
5,276,380 A 1/1994 Tang
5,294,869 A 3/1994 Tang et al.
5,294,870 A 3/1994 Tang et al.
5,302,966 A * 4/1994 Stewart ..... 345/76
5,384,267 A 1/1995 Hutchins et al.
5,384,517 A 1/1995 Uno
5,400,050 A 3/1995 Matsumoto et al.
5,508,715 A 4/1996 Kuroki (Continued)

FOREIGN PATENT DOCUMENTS

EP 0 177 247 4/1986

(Continued)

OTHER PUBLICATIONS

Specification, Abstract, and Drawings, of U.S. Appl. No. 09/226,012, filed Mar. 11,1999 entitled *Thin Film Transistor Organic Electroluminescence Display Device and Manufacturing Method of the Same.*

(Continued)

*Primary Examiner*—Ricardo Osorio
(74) *Attorney, Agent, or Firm*—Eric J. Robinson; Robinson Intellectual Property Law Office, P.C.

(57) ABSTRACT

An active matrix type flat-panel display device includes a flat substrate, a plurality of light emissive elements arranged two dimensionally along columns and lines on the flat substrate, a plurality of selection switches formed on the flat substrate, for sequentially selecting the light emissive elements to provide video signals thereto, selection signal generation circuits for providing selection signals which drive the selection switches in sequence so as to two dimensionally scan the light emissive elements, and a selection signal control circuit for preventing the selection signals from being output from the selection signal generation circuits for a predetermined period of time so as to eliminate overlap between the selection signals.

22 Claims, 5 Drawing Sheets

U.S. PATENT DOCUMENTS

| | | | | | |
|---|---|---|---|---|---|
| 5,526,013 | A | | 6/1996 | Ono et al. | |
| 5,550,066 | A | | 8/1996 | Tang et al. | |
| 5,578,166 | A | | 11/1996 | Hirota | |
| 5,621,427 | A | | 4/1997 | Kanbe et al. | |
| 5,623,157 | A | | 4/1997 | Miyazaki et al. | |
| 5,642,129 | A | | 6/1997 | Zavracky et al. | |
| 5,670,792 | A | * | 9/1997 | Utsugi et al. | 257/59 |
| 5,684,365 | A | | 11/1997 | Tang et al. | |
| 5,714,968 | A | * | 2/1998 | Ikeda | 345/77 |
| 5,808,315 | A | | 9/1998 | Murakami et al. | |
| 5,828,429 | A | | 10/1998 | Takemura | |
| 5,986,632 | A | | 11/1999 | Takayama et al. | |
| 6,023,308 | A | | 2/2000 | Takemura | |
| 6,031,290 | A | | 2/2000 | Miyazaki et al. | |
| 6,147,451 | A | * | 11/2000 | Shibata et al. | |
| 6,157,356 | A | * | 12/2000 | Troutman | |
| 6,166,414 | A | | 12/2000 | Miyazaki et al. | |
| 6,448,612 | B1 | | 9/2002 | Miyazaki et al. | |

FOREIGN PATENT DOCUMENTS

| | | |
|---|---|---|
| JP | 58-054391 | 3/1983 |
| JP | 61-048893 | 3/1986 |
| JP | 61-052631 | 3/1986 |
| JP | 61-080226 | 4/1986 |
| JP | 61-116334 | 6/1986 |
| JP | 04-125683 | 4/1992 |
| JP | 04-161984 | 6/1992 |
| JP | 4-328791 | 11/1992 |
| JP | 05-075957 | 3/1993 |
| JP | 05-241536 | 9/1993 |
| JP | 6-64229 | 3/1994 |
| JP | 06-161380 | 6/1994 |
| JP | 06-161385 | 6/1994 |
| JP | 06-222739 | 8/1994 |
| JP | 06-090954 | 11/1994 |

OTHER PUBLICATIONS

Official Action dated Jul. 28, 2003 and corresponding pending claims of U.S. Appl. No. 09/266,012, filed Mar. 11, 1999 entitled *Thin Film Transistor Organic Electroluminescence Display and Manufacturing Method of the Same*.

Official Action dated Mar. 29, 2004 and corresponding pending claims of U.S. Appl. No. 09/266,012, filed Mar. 11, 1999 entitled *Thin Film Transistor Organic Electroluminescence Display Device and Manufacturing Method of the Same*.

* cited by examiner

ACTIVE MATRIX TYPE FLAT-PANEL DISPLAY DEVICE

This application is a Division of application Ser. No. 08/547,919 filed Oct. 25, 1995 now U.S. Pat. No. 5,986,632.

FIELD OF THE INVENTION

The present invention relates to an active matrix type flat-panel display device with light emissive elements such as EL (electro luminescent) elements or light nonemissive elements such as liquid crystal elements arranged two dimensionally in matrix and sequentially driven by means of respective drive thin film transistors (TFTs).

DESCRIPTION OF THE RELATED ART

An active matrix type flat-panel display device with light emissive elements and respective driver TFTs which are two dimensionally arranged along X-axis and Y-axis in matrix is known. In such a device, the drive TFTs of the respective picture elements are sequentially scanned by column-selecting transistors (TFTs) and line-selecting transistors (TFTs). Each of the column-selecting transistors, which are sequentially turned on by means of an X-axis shift register, is connected to each column. The line-selecting transistors are prepared for the respective drive TFTs and sequentially turned on by means of a Y-axis shift register so that the line-selecting transistors connected to each line are simultaneously turned on.

According to such a device, since each of the column-selecting transistors has to drive all the drive TFTs on that column, it is necessary to use as a high power transistor for this column-selecting transistor. Particularly, in case that the light emissive elements are constituted by high speed elements such as EL elements, high speed switching operation will be required by using extremely high power TFTs.

These high power TFTs for the column-selecting transistors result in a time constant, determined by their large gate capacitance and on-resistance of circuits connected to the gates of the column-selecting transistors, to extremely increase and thus cause rise edges and fall edges of selection signals, applied to these respective gates, to delay by a certain period $\Delta T$. Therefore, a selection signal to be applied to one column-selecting transistor will overlap on a next selection signal to be applied to the next column-selecting transistor for the delay time $\Delta T$ causing both of the neighboring column-selecting transistors to simultaneously keep on during this period $\Delta T$. As a result, a video signal for light emissive element positioned at a certain column and a certain line will stray into a next light element positioned at the neighboring column and the same line causing picture quality of the display device to deteriorate.

SUMMARY OF THE INVENTION

It is therefore an object of the present invention to provide an active matrix type flat-panel display device whereby picture quality can be greatly improved by preventing overlap between selection signals of neighboring columns or lines from occurring.

According to the present invention, an active matrix type flat-panel display device includes a flat substrate, a plurality of light emissive elements arranged two dimensionally along columns and lines on the flat substrate, a plurality of selection switches formed on the flat substrate, for sequentially selecting the light emissive elements to provide video signals thereto, selection signal generation circuits for providing selection signals which drive the selection switches in sequence so as to two dimensionally scan the light emissive elements, and a selection signal control circuit for preventing the selection signals to be outputted from the selection signal generation circuits for a predetermined period of time so as to eliminate overlap between the selection signals.

Thus, overlap between selection signals of neighboring columns or lines can be prevented from occurring causing picture quality to be greatly improved.

Preferably, the selection switches consist of column-selecting transistors arranged for the respective columns of the light emmisive elements, and line-selecting transistors arranged for the respective light emissive elements.

The column-selecting transistors and the line-selecting transistors may be formed by thin film transistors.

It is preferred that the selection signal generation circuits include a first shift register for providing the selection signals in sequence to the column-selecting transistors, and a second shift register for providing the selection signals in sequence to the line-selecting transistors.

Preferably, the selection signal control circuit includes a mask signal generation circuit for producing a mask signal with a duration of time which corresponds to the predetermined period of time, and a logic circuit for shortening a duration of the selection signals by the duration of the mask signal.

The above-mentioned predetermined period time may be equal to 5 to 50% of a half clock cycle.

The light emissive elements may consist of organic electro luminescent elements, non-organic electro luminescent elements, ferroelectric liquid crystal elements or field emission diodes.

Further objects and advantages of the present invention will be apparent from the following description of the preferred embodiments of the invention as illustrated in the accompanying drawings.

DESCRIPTION OF THE PREFERRED EMBODIMENTS

Figure 1:
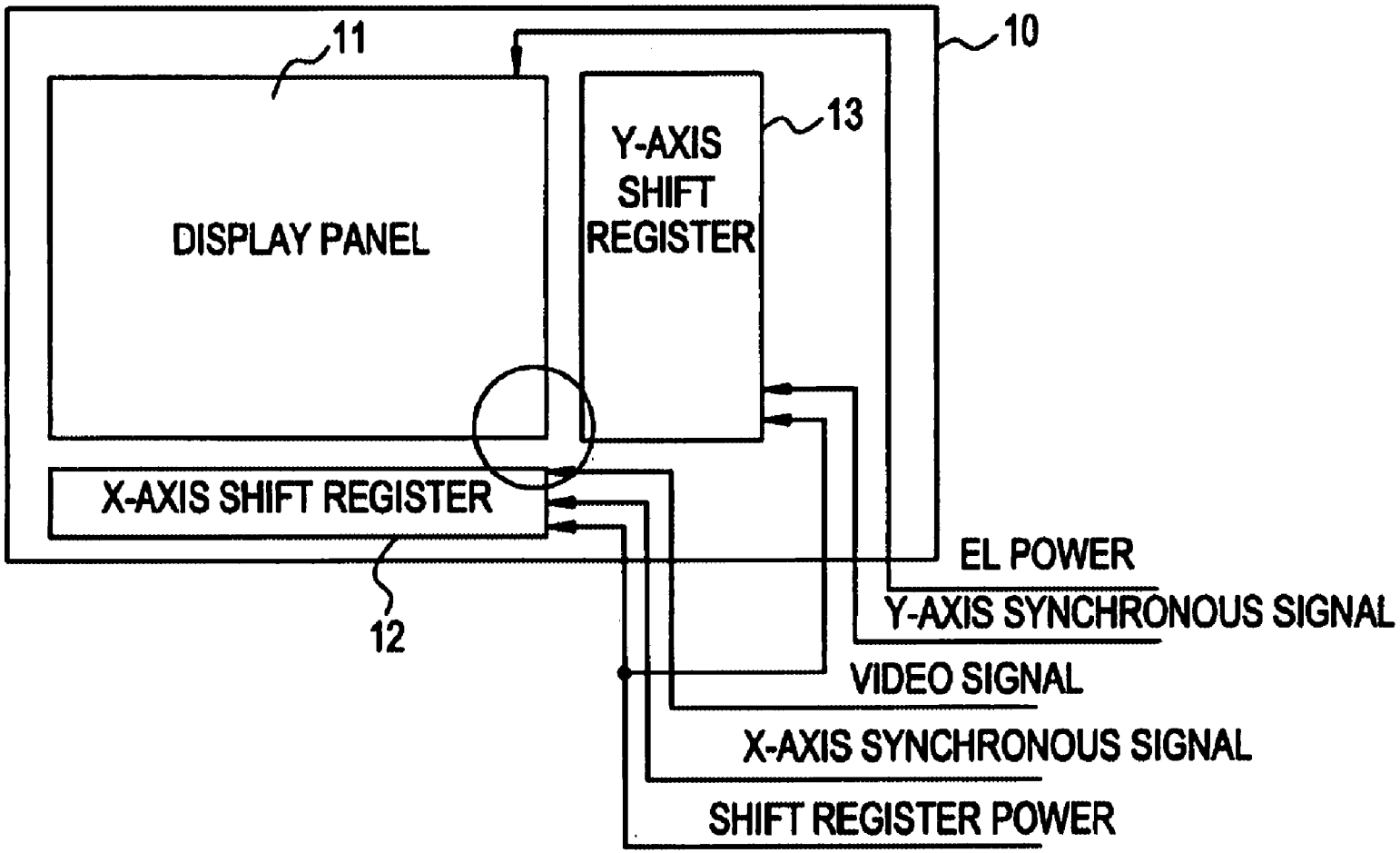
FIG. 1 schematically shows a part of a preferred embodiment of an active matrix type flat-panel display device according to the present invention.

FIG. 1 schematically shows a part of a preferred embodiment of an active matrix type flat-panel display device according to the present invention.

As illustrated in the figure, the display device 10 has a flat display panel 11, an X-axis shift register 12 and a Y-axis shift register 13.

The flat display panel 11 has a substrate (not indicated) and a plurality of picture elements of light emissive elements which are two dimensionally arranged along X-axis and Y-axis in matrix on the substrate. In this embodiment, the light emissive elements are constituted by organic EL (electro luminescent) elements. To the respective picture elements of the display panel 11, EL power and video signal are supplied. To the X-axis shift register 12, shift register power and an X-axis synchronous signal are supplied. To the Y-axis shift register 13, shift register power and a Y-axis synchronous signal are supplied.

Figure 2:
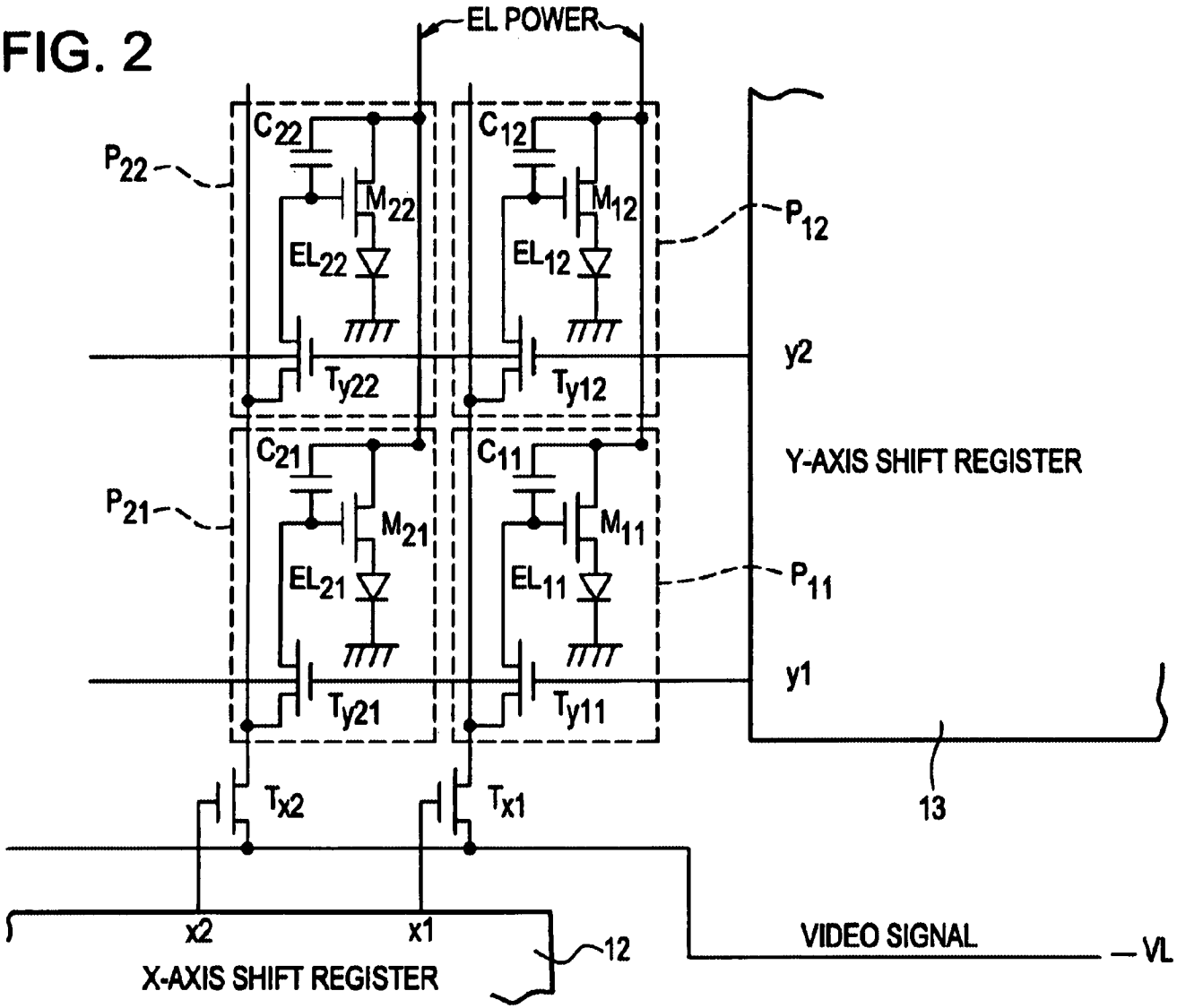
FIG. 2 shows in detail a part of the display device of FIG. 1.

FIG. 2 is an enlarged view of a circled portion in FIG. 1. As will be apparent from this figure, each of the picture elements $P_{11}$, $P_{12}$, . . . $P_{21}$, $P_{22}$, . . . (illustrated by rectangles of broken lines) of the flat display panel 11 is constituted by two TFTs, a capacitor and an EL element.

Light emitting operation of the picture element P1, for example will be carried out as follows. When a selection signal x1 is output from the X-axis shift register 12 and a selection signal y1 is output from the Y-axis shift register 13, a column-selecting transistor (TFT) $T_{x1}$ and a line selecting transistor (TFT) $T_{y11}$ are turned on. Thus, the video signal −VL is applied to a gate of a drive transistor (TFT) $M_{11}$ via the transistors $T_{x1}$ and $T_{y11}$. Accordingly, a current with a value depending upon the gate voltage −VL flows from the EL power supply through drain and source of the drive transistor $M_{11}$ causing an EL element $EL_{11}$, of this picture element $P_{11}$ to emit light with a luminance corresponding to the voltage of the video signal −VL.

At a next timing, the X-axis shift register 12 turns off the selection signal x1 and outputs a selection signal x2. However, since the preceding gate voltage of the transistor $M_{11}$ is held by a capacitor $C_{11}$, the picture element $P_{11}$ will keep emitting light with a luminance corresponding to the voltage of the video signal −VL until this picture element $P_{11}$ is selected again.

Figure 3:
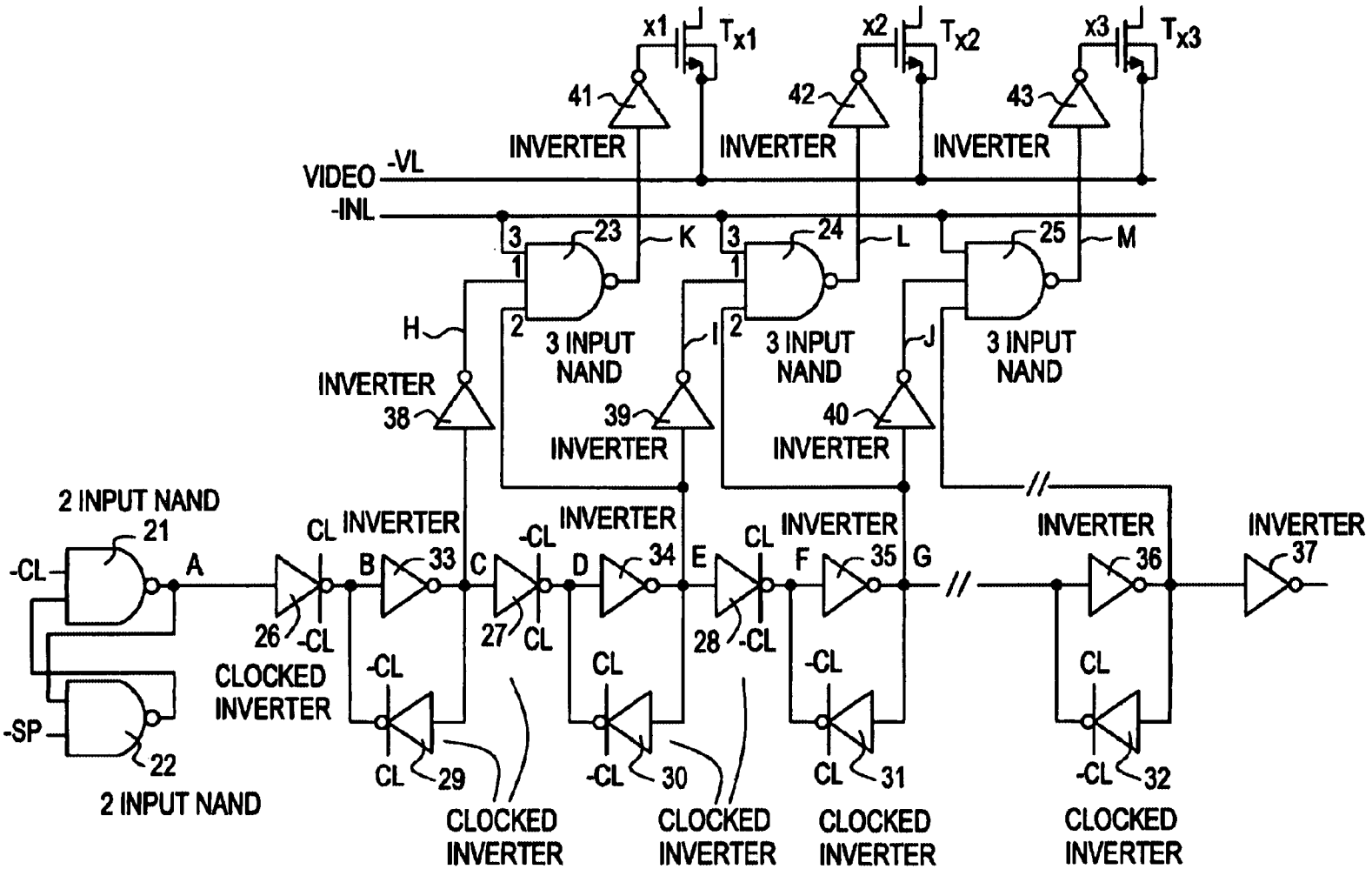
FIG. 3 shows a concrete constitution of a part of an X-axis shift register illustrated in FIG. 1.

FIG. 3 shows a concrete constitution of a part of the X-axis shift register 12 in the embodiment of FIG. 1.

In the figure, two input NAND circuits 21 and 22 constitute a wave-form shaping circuit for shaping a wave-form of an input signal to synchronize with basic clocks. The NAND circuit 21 is connected such that inverse basic clocks −CL having inverted phase with respect to the basic clocks are input into one input terminal of the NAND circuit 21 and that an output signal from the NAND circuit 22 is input into the other input terminal thereof. The NAND circuit 22 is connected such that a start pulse −SP with low level (L-level) will be input into one input terminal of the NAND circuit 22 and that an output signal from the NAND circuit 21 is input into the other input terminal thereof. The start pulse −SP is an X-axis synchronous signal which defines a start time of scanning toward the column direction.

The output terminal of the NAND circuit 21 is connected to an input terminal of a clock inverter 26. This clocked inverter 26, clocked inverters 29 to 32 and inverters 33 to 37 constitute a shift register portion. Namely, each of the stages of the shift register portion is formed as follows. The first stage is constituted by the clocked inverter 26, the inverter 33 connected to this clocked inverter 26 in series and the clocked inverter 29 connected to the inverter 33 in parallel but in an opposite direction. The second stage is constituted by the clocked inverter 27, the inverter 34 connected to this clocked inverter 27 in series and the clocked inverter 30 connected to the inverter 34 in parallel but in the opposite direction. The third stage is constituted by this clocked inverter 28, the inverter 35 connected to this clocked inverter 28 in series and the clocked inverter 31 connected to the inverter 35 in parallel but in the opposite direction.

The output terminal of the NAND circuit 21 is connected to an input terminal of a clocked inverter 26. This clocked inverter 26, clocked inverters 29 to 32 and inverters 33 to 37 constitute a shift register portion. Namely, each of stages of the shift register portion is formed as follows. The first stage is constituted by the clocked inverter 26, the inverter 33 connected to this clocked inverter 26 in series and the clocked inverter 29 connected to the inverter 33 in parallel but in opposite direction. The second stage is constituted by the clocked inverter 27, the inverter 34 connected to this clocked inverter 27 in series and the clocked inverter 30 connected to the inverter 34 in parallel but in opposite direction. The third stage is constituted by the clocked inverter 28, the inverter 35 connected to this clocked inverter 28 in series and the clocked inverter 31 connected to the inverter 35 in parallel but in opposite direction.

Inverters 38 to 43 and three-input NAND circuits 23 to 25 constitute a logic circuit portion for providing selection signals x1 to x3. An output terminal of the first stage of the shift register portion (output terminal of the inverter 33) is coupled with a first input terminal of the three-input NAND circuit 23 via the inverter 38. An output terminal of the second stage of the shift register portion (output terminal of the inverter 34) is coupled with a first input terminal of the three-input NAND circuit 24 via the inverter 39 and directly connected to a second input terminal of the NAND circuit 23. An output terminal of the third stage of the shift register portion (output terminal of the inverter 35) is coupled with a first input terminal of the three-input NAND circuit 25 via the inverter 40 and directly connected to a second input terminal of the NAND circuit 24.

Figure 4:
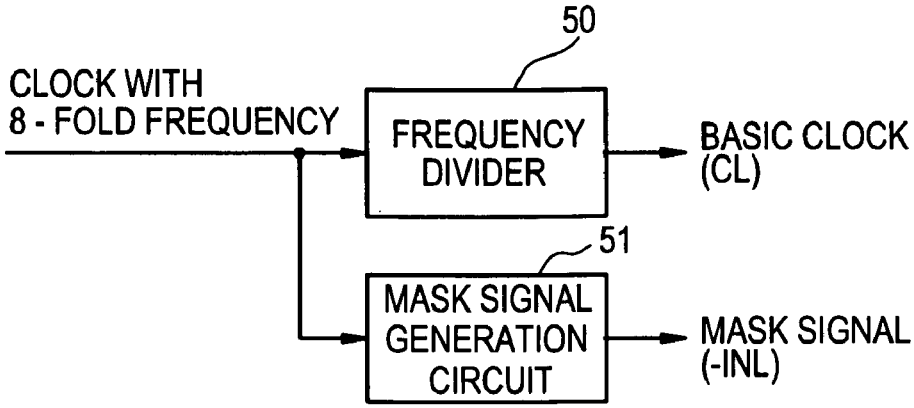
FIG. 4 schematically shows a constitution of a clock signal and mask signal generation circuit.

Third input terminals of the NAND circuits 23 to 25 are connected to a mask signal generation circuit 51 shown in FIG. 4 to receive a mask signal −INL. An output terminal of the NAND gate 23 is coupled with a gate of a first column switching transistor $T_{x1}$ via the inverter 41. An output terminal of the NAND gate 24 is coupled with a gate of a second column switching transistor $T_{x2}$ via the inverter 42. An output terminal of the NAND gate 25 is coupled with a gate of a third column switching transistor $T_{x3}$ via the inverter 43. Into sources of the switching transistors $T_{x1}$ to $T_{x3}$, video signal −VL is applied.

The clocked inverter will be in active and operate as an inverter when an L-level signal is applied to a clock input terminal shown at an upper side and also a H-level signal is applied to an inverted clock input terminal shown at a lower side. Contrary to this, it will turn into a high impedance state when the H-level signal is applied to the clock input terminal and the L-level signal is applied to the inverted clock input terminal. For example, since the clocked inverters 26 and 29 are constituted to receive opposite phase clocks with each other as shown in FIG. 3, the clocked inverter 26 will be in active when the clocked inverter 29 is in a high impedance state.

Figure 5:
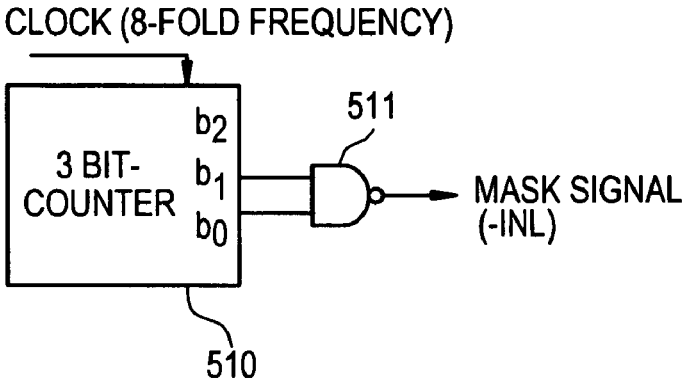
FIG. 5 shows a concrete constitution of a mask signal generation circuit illustrated in FIG. 4.
Figure 6:
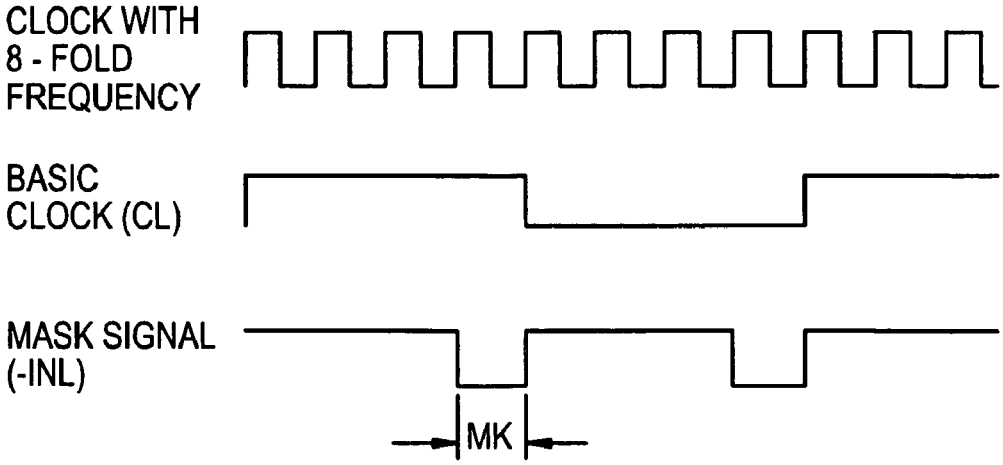
FIG. 6 illustrates wave forms of a clock signal and a mask signal in the circuit of FIG. 4.

FIG. 4 schematically shows a constitution of a clock signal and mask signal generation circuit, FIG. 5 shows a concrete constitution of a mask signal generation circuit illustrated in FIG. 4, and FIG. 6 illustrates waveforms of a clock signal and a mask signal in the circuit of FIG. 4.

As shown in FIG. 4, the clock signal and mask signal generation circuit consists of a frequency divider 50 for dividing, by eight, frequency of a clock signal with eight-fold frequency, produced by a clock generator (not shown) to produce a basic clock signal CL, and a mask signal generation circuit 51 for producing a mask signal −INL from the clock signal with eight-fold frequency.

The frequency divider 50 may be constituted by a counter for counting the input clock signals to output the basic clock signal with H-level and L-level which alternate at every four input clock signals. Thus, the basic clock CL will have eight-fold pulse width in comparison with that of the input clock signal with eight-fold frequency as shown in FIG. 6.

As shown in FIG. 5, the mask signal generation circuit 51 consists of a three-bit counter 510 and a two-input NAND circuit 511 so as to count the input clock signal with eight-fold frequency for three clock cycles and provide an output signal with a one clock cycle duration of a L-level. Thus, the mask –INL having a predetermined mask period of time MK can be obtained. As will be apparent from FIG. 6, this mask period MK is equal to a quarter of a half clock cycle. The mask period MK according to this invention is not limited to a quarter of a half clock cycle but can be determined to an optional period equal to or longer than an overlapped period ΔT of the selection signals. In practice, it is desired to select the mask period MK between about 5 and 50% of the half clock cycle.

Figure 7:
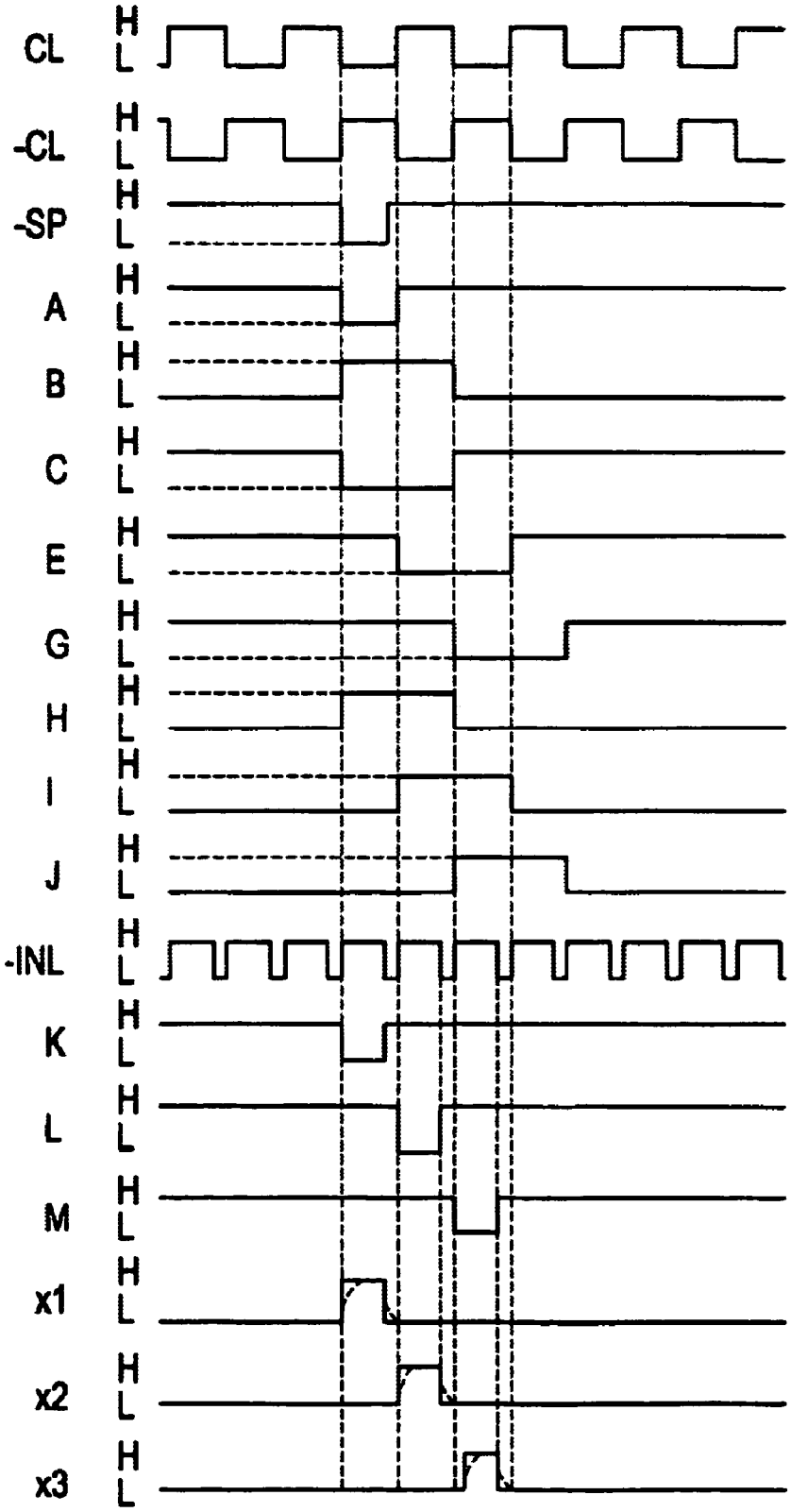
FIG. 7 illustrates wave forms of various signals in the X-axis shift register of FIG. 3.

FIG. 7 illustrates waveforms of various signals in the X-axis shift register of FIG. 3. Hereinafter, operation of this embodiment will be illustrated in detail.

Output voltage A from the wave-form shaping circuit will be maintained at H-level when the start pulse of L-level –SP is not input. When the start pulse of L-level is input, the voltage A falls to L-level. As shown in FIG. 7, the start pulse –SP which is somewhat delayed due to a possible capacitance of input lead wires is shaped by the wave-form shaping circuit (21, 22) to synchronize with the basic clock CL.

When the voltage A falls to L-level, state of the clocked inverter 26 changes into active and thus output voltage B from the clocked inverter 26 will rise to H-level. Output voltage C from the inverter 33 (output from the first stage of the shift register) has an opposite phase waveform as that of the voltage B due to the inverter 33.

When the state of the clocked inverter 26 changes into high impedance in next, since the clocked inverter 29 is in active, the voltage B is kept on H-level during this active period of the clocked inverter 29. Namely, the inverter 33 and the clocked inverter 29 constitutes a hold circuit.

Output voltage D from the clocked inverter 27 has a waveform delayed by a half clock cycle from that of the voltage B due to the operations of the clocked inverter 27 itself which simultaneously changes into active state with the clocked inverter 29 and of a hold circuit constituted by the inverter 34 and the clocked inverter 30.

Output voltage E from the inverter 34 (output from the second stage of the shift register) has an opposite phase waveform as that of the voltage D due to inverter 34 and also has a waveform delayed by a half clock cycle from that of the voltage C.

Output voltage F from the clocked inverter 28 has a waveform delayed by a half clock cycle from that of the voltage D due to the operations of the clocked inverter 28 itself which simultaneously changes into active state with the clocked inverter 30 and of a hold circuit constituted by the inverter 35 and the clocked inverter 31.

Output voltage G from the inverter 35 (output from the third stage of the shift register) has an opposite phase waveform as that of the voltage F due to the inverter 35 and also has a waveform delayed by a half clock cycle from that of the voltage E.

The voltage C is inverted by the inverter 38 and an inverter voltage H which is maintained H-level for a clock cycle is applied to a first input terminal of the three input NAND circuit 23. The voltage E having a waveform delayed by a half clock cycle from that of the voltage C is applied to a second input terminal of the NAND circuit 23. The mask signal –INL is applied to a third input terminal of the NAND circuit 23. The mask period MK of the mask signal –INL is determined to a certain period so that the falling edge of the selection signal x1 and the rising edge of the next selection signal x2 will not overlap with each other.

Low-level duration of output voltage K from the NAND circuit 23 is shorter than that of the basic clock CL by the mask period MK. In other words, the output voltage K rises earlier than the basic clock CL by the mask period MK. This output voltage K is inverted by the inverter 41 to produce the selection signal x1.

The selection signal x1 is applied to the gate of the column-selecting transistor (TFT) $T_{x1}$ which is formed by a N-channel field effect transistor. Thus, when the selection signal x1 rises to H-level, the transistor $T_{x1}$ turns on.

The voltage E is inverted by the inverter 39 and an inverted voltage I which is maintained at a H-level for a clock cycle is applied to a first input terminal of the three input NAND circuit 24. The voltage G having a waveform delayed by a half clock cycle from that of the voltage E is applied to a second input terminal of the NAND circuit 24. The mask signal –INL is applied to a third input terminal of the NAND circuit 24.

Low-level duration of output voltage L from the NAND circuit 24 is shorter than that of the basic clock CL by the mask period MK. In other words, the output voltage L rises earlier than the basic clock CL by the mask period MK. This output voltage L is inverted by the inverter 42 to produce the selection signal x2.

The selection signal x2 is applied to the gate of the column-selecting transistor (TFT) $T_{x2}$ which is formed by a N-channel field effect transistor. Thus, when the selection signal x2 rises to H-level, the transistor $T_{x2}$ turns on.

The voltage G is inverted by the inverter 40 and an inverter voltage J which is maintained H-level for a clock cycle is applied to a first input terminal of the three input NAND circuit 25. The voltage having a waveform delayed by a half clock cycle from that of the voltage G is applied to a second input terminal of the NAND circuit 25. The mask signal –INL is applied to a third input terminal of the NAND circuit 25.

Low-level duration of output voltage M from the NAND circuit 25 is shorter than that of the basic clock CL by the mask period MK. In other words, the output voltage M rises earlier than the basic clock CL by the mask period MK. This output voltage M is inverted by the inverter 43 to produce the selection signal x3.

The selection signal x3 is applied to the gate of the column-selecting transistor (TFT) $T_{x3}$ which is formed by a N-channel field effect transistor. Thus, when the selection signal x3 rises to H-level, the transistor $T_{x3}$ turns on.

Similar to this, the selection signals x1, x2, x3, . . . which are sequentially shifted by a half clock cycle with each other can be provided.

As described before, the waveforms of these selection signals x1, x2, x3, . . . shown in FIG. 7 by solid lines are ideal waveforms and actual waveforms applied to the respective gates of the transistors $T_{x1}$, $T_{x2}$, $T_{x3}$ . . . may be as shown in FIG. 7 by broken lines. Namely, rising edges and falling edges of the selection signals may delay by a certain period ΔT due to the large gate capacitance of the transistors $T_{x1}$, $T_{x2}$, $T_{x3}$ . . . and on-resistance of the inverters 41, 42, 43, . . . .

However, according to the present invention, since the mask period MK during which no H-level signal exists is provided between the selection signals, the switching transistor for example $T_{x1}$ and the next switching transistor for example $T_{x2}$ can never simultaneously be in an on state.

Therefore, according to the present invention, picture quality of an active matrix type flat-panel display device can be greatly improved by preventing overlap between selection signals of neighboring columns or lines from occurring.

The light emissive elements may be constituted by non-organic EL elements, FLC (Ferroelectric Liquid Crystal) elements or FEDs (Field Emission Diodes) other than above-described organic EL elements.

Many widely different embodiments of the present invention may be constructed without departing from the spirit and scope of the present invention. It should be understood that the present invention is not limited to the specific embodiments described in the specification, except as defined in the appended claims.

What is claimed is:

1. A display device comprising:

a substrate;

a plurality of light emissive elements arranged in a matrix form over said substrate;

a plurality of first thin film transistors formed over said substrate;

a plurality of second thin film transistors formed over said substrate and connected to said plurality of light emissive elements, respectively, wherein one of said first thin film transistors is connected to a gate of one of said second thin film transistors; and a circuit for driving said first thin film transistors, said circuit comprising third thin film transistors formed over said substrate, wherein each of said light emissive elements comprises an organic electroluminescent material.

2. The display device according to claim 1 further comprising a first shift register and a second shift register, electrically connected to said plurality of first thin film transistors.

3. The display device according to claim 1 further comprising a power supply line connected to said second thin film transistors.

4. The display device according to claim 1 wherein said third thin film transistors are column-selecting transistors.

5. An active matrix type organic luminescent display device comprising:

a substrate;

at least one first signal line and one second signal line formed over said substrate, said at least one first signal line and one second signal intersecting each other over said substrate;

a first thin film transistor formed over said substrate, wherein said first signal line is connected to a gate of said first thin film transistor and said second signal line is connected to a source or drain of the first thin film transistor;

a second thin film transistor formed over said substrate wherein the other one of the source or drain of the first thin film transistor is connected to a gate of the second thin film transistor;

an organic electroluminescent element formed over said substrate and electrically connected to a source or drain of said second thin film transistor;

a power supply line electrically connected to the other one of the source or drain of the second thin film transistor; and a circuit for driving said first thin film transistor, said circuit comprising third thin film transistors formed over said substrate.

6. The display device according to claim 5 wherein a video signal is applied to the gate of the second thin film transistor through said second signal line and said first thin film transistor.

7. The display device according to claim 5 wherein said power supply line extends in parallel with said second signal line.

8. The display device according to claim 5 wherein said third thin film transistors are column-selecting transistors.

9. An active matrix type organic luminescent display device comprising:

a substrate;

at least one first signal line and one second signal line formed over said substrate, said at least one first signal line and one second signal intersecting each other over said substrate;

a first thin film transistor formed over said substrate, wherein said first signal line is connected to a gate of said first thin film transistor and said second signal line is connected to a source or drain of the first thin film transistor;

a second thin film transistor formed over said substrate, wherein the other one of the source or drain of the first thin film transistor is connected to a gate of the second thin film transistor;

an organic electroluminescent element formed over said substrate and electrically connected to a source or drain of said second thin film transistor;

a power supply line electrically connected to the other one of the source or drain of the second thin film transistor;

a capacitor formed between the gate of the second thin film transistor and the source or drain of the second thin film transistor to which said power supply line is connected; and a circuit for driving said first thin film transistor, said circuit comprising third thin film transistors formed over said substrate.

10. The display device according to claim 9 wherein a video signal is applied to the gate of the second thin film transistor through said second signal line and said first thin film transistor.

11. The display device according to claim 9 wherein said power supply line extends in parallel with said second signal line.

12. The display device according to claim 9 further comprising a first shift register and a second shift register, electrically connected to said plurality of first thin film transistors.

13. The display device according to claim 9 wherein said third thin film transistors are column-selecting transistors.

14. An active matrix type organic luminescent display device comprising:

a substrate;

at least one first signal line and one second signal line formed over said substrate, said at least one first signal line and one second signal intersecting each other over said substrate;

a first thin film transistor formed over said substrate, wherein said first signal line is connected to a gate of said first thin film transistor and said second signal line is connected to a source or drain of the first thin film transistor;

a second thin film transistor formed over said substrate, wherein the gate of said second thin film transistor is electrically connected to said second signal line through said first thin film transistor;

an organic electroluminescent element formed over said substrate;

a power supply line electrically connected to said organic electroluminescent element through said second thin film transistor; and a circuit for driving said first thin film transistors, said circuit comprising third thin film transistors formed over said substrate.

15. The display device according to claim 14 wherein a video signal is applied to the gate of the second thin film transistor through said second signal line and said first thin film transistor.

16. The display device according to claim 14 wherein said power supply line extends in parallel with said second signal line.

17. The display device according to claim 14 wherein said third thin film transistors are column-selecting transistors.

18. An active matrix type organic luminescent display device comprising:

a substrate;

at least one first signal line and one second signal line formed over said substrate, said at least one first signal line and one second signal intersecting each other over said substrate;

a first thin film transistor formed over said substrate, wherein said first signal line is connected to a gate of said first thin film transistor;

a second thin film transistor formed over said substrate, wherein a gate of said second thin film transistor is electrically connected to said second signal line through said first thin film transistor;

an organic electroluminescent element formed over said substrate;

a power supply line formed over said substrate and electrically connected to said organic electroluminescent element through said second thin film transistor;

a capacitor formed between the gate of the second thin film transistor and said power supply line; and a circuit for driving said first thin film transistors, said circuit comprising third thin film transistors formed over said substrate.

19. The display device according to claim 18, wherein said power supply line extends in parallel with said second signal line.

20. The display device according to claim 18, wherein said power supply line extends in parallel with said second signal line.

21. The display device according to claim 18, further comprising a first shift register and a second shift register, electrically connected to said plurality of first thin film transistors.

22. The display device according to claim 18 wherein said third thin film transistors are column-selecting transistors.

* * * * *